Publication No. 12953/1979), RMgX—halogenated phenol—$TiCl_4$ (Japanese Patent Publication No. 12954/1979) and RMgX—$CO_2$—$TiCl_4$ (Japanese Patent Laid Open Publication No. 73009/1982).

Further examples of the catalyst are combinations of organoaluminum compounds with solid materials obtained by contacting the above-exemplified solid materials containing at least magnesium and titanium with inorganic oxides such as $SiO_2$ and $Al_2O_3$. Other examples of inorganic oxides than $SiO_2$ and $Al_2O_3$ include CaO, $B_2O_3$ and $SnO_2$. Double oxides of these oxides are also employable. As the method of contacting these inorganic oxides with the solid materials containing magnesium and titanium, there may be adopted a known method. For example, both may be reacted at a temperature of 20° to 400° C., preferably 50° to 300° C., for usually 5 minutes to 20 hours in the presence or absence of an inert solvent, or may be reacted by a co-pulverization treatment or by a combination of these methods. More concrete examples are combinations of organoaluminum compounds with the following solid material systems: $SiO_2$—ROH—$MgCl_2$—$TiCl_4$ (see Japanese Patent Laid Open Publication No. 47407/1981), $SiO_2$—R—O—R'—MgO—$AlCl_3$—$TiCl_4$ (Japanese Patent Laid Open Publication No. 187305/1982) and $SiO_2$—$MgCl_2$—$Al(OR)_3$—$TiCl_4$—$Si(OR')_4$ (Japanese Patent Laid Open Publication No. 21405/1983) in which formulae R and R' are each a hydrocarbon radical.

In the catalyst systems exemplified above, the titanium compounds may be used as adducts with organocarboxylic acid esters, and the magnesium-containing inorganic solid compounds may be used after contact treatment with organocarboxylic acid esters. Moreover, the organoaluminum compounds may be used as adducts with organocarboxylic acid esters. Further, the catalyst preparation may be performed in the presence of an organocarboxylic acid ester.

As examples of the organocarboxylic acid ester, there may be mentioned various aliphatic, alicyclic and aromatic carboxylic acid esters, preferably aromatic carboxylic acid esters having 7 to 12 carbon atoms, including alkyl esters such as methyl and ethyl esters of benzoic, anisic and toluic acids.

Preferred examples of the organoaluminum compound to be combined with the solid material are those represented by the general formulae $R_3Al$, $R_2AlX$, $RAlX_2$, $R_2AlOR$, $RAl(OR)X$ and $R_3Al_2X_3$ wherein R, which may be alike or different, is an alkyl, aryl or aralkyl group having 1 to 20 carbon atoms and X is a halogen atom, including triethylaluminum, triisobutylaluminum, trihexylaluminum, trioctylaluminum, diethylaluminum chloride, diethylaluminum ethoxide, ethylaluminum sesquichloride, and mixtures thereof.

The amount of the organoaluminum compound used is not specially limited, but usually it is in the range of 0.1 to 1,000 moles per mole of the titanium compound.

The catalyst may be contacted with an α-olefin before its use in the polymerization reaction, whereby the polymerization activity can be greatly improved and a stabler operation is ensured than in the omission of such treatment. Various α-olefins are employable. Preferred examples are α-olefins having 3 to 12, more preferably 3 to 8, carbon atoms, including propylene, butene-1, pentene-1,4-methylpentene-1, hexene-1, octene-1, decene-1, dodecene-1, and mixtures thereof. The temperature and time of the contact treatment between the catalyst and α-olefin can be selected over a wide range. For example, both may be contacted at a temperature of 0° to 200° C., preferably 0° to 110° C., for 1 minute to 24 hours. The amount of α-olefin to be contacted can also be selected over a wide range, but it is desirable to treat the catalyst with 1 to 50,000 g., preferably 5 to 30,000 g., of α-olefin per gram of the solid material so that 1 to 500 g. of α-olefin per gram of the solid material is allowed to react. The contact pressure is not specially limited, but preferably it is in the range of −1 to 100 kg/cm$^2$.G.

The contact treatment with α-olefin may be carried out by first combining the total amount of the thus-prepared catalyst with the α-olefin. Alternatively, it may be performed by first combining a part of the organoaluminum compound with the solid material, then contacting this mixture with the α-olefin and adding the remaining organoaluminum compound separately at the time of polymerization reaction. Further, this α-olefin treatment for the catalyst may be conducted in the presence of hydrogen gas or other inert gas such as nitrogen, argon or helium.

The polymerization reaction is carried out in the same way as in conventional olefin polymerization reactions using Ziegler type catalysts. More particularly, the reaction is performed in a substantially oxygen- and water-free condition, in vapor phase, or in the presence of an inert solvent or using monomers as solvents. Olefin polymerizing conditions involve temperatures in the range of 20° to 300° C., preferably 40° to 200° C., and pressures in the range of atmospheric pressure to 70 kg/cm$^2$.G, preferably 2 to 60 kg/cm$^2$.G. The molecular weight can be adjusted to some extent by changing polymerization conditions such as the polymerization temperature and the catalyst mole ratio, but the addition of hydrogen into the polymerization system is more effective for this purpose. Of course, two or more multistage polymerization reactions involving different polymerization conditions such as different hydrogen concentrations and different polymerization temperatures can be performed without any trouble.

Thus, by using the ethylene/α-olefin copolymer obtained by copolymerizing ethylene and $C_2$ to $C_{12}$ α-olefin in the presence of the catalyst comprising the solid material containing magnesium and titanium and the organoaluminum compound, in combination with carbon black, there can be obtained the electrically-conductive composition of the invention having superior characteristics. This is quite unexpected and surprising.

As copolymers similar to the ethylene/α-olefin copolymer used in the present invention there have been known ethylene/α-olefin copolymers prepared using vanadium catalysts. But, these similar copolymers are clearly different from the copolymers used in the present invention. Even on the same density level, the former is low in the maximum peak temperature (Tm) according to DSC, and its percent insoluble in boiling n-hexane is zero to trace, while that of the copolymer used in the present invention is not less than 10 wt.%. In comparison with the copolymers prepared using vanadium catalysts, the copolymer used in the present invention is superior in heat resistance and mechanical strength, which is attributable to the above differences between the two. Further, a catalyst removing step is essential to the former because the vanadium compound remaining as residual catalyst in the copolymer is toxic, while the use of titanium as in the present invention does not cause the problem of toxicity and its combination with the magnesium compound affords a high ac-

THICK FILM THERMISTOR COMPOSITION

BACKGROUND OF THE INVENTION

1. Field of the Invention

This invention relates to a thick film thermistor composition.

2. Description of the Prior Art

Heretofore, thick film thermistors have been formed according to the ordinary thick film technique comprising steps of screen printing a thermistor paste comprising powders having a thermistor characteristic, glass powder, and an organic vehicle on an insulating substrate, firing, etc., and their structures can be classified into two main groups: thick film resistor type structure (which will be hereinafter referred to as a sheet type) and thick film condenser type structure (which will be hereinafter referred to as a sandwich type). Thermistor materials having a high stability now employed in the bead-form thermistor or disc-form thermistor, or the like have a high specific resistance, for example, 500 Ω-cm or higher, and the glass itself has a very high specific resistance. Thus, when a thick film thermistor is prepared from these materials, the structure is always of sandwich type which naturally provides a low resistance. The sandwich type thick film resistor is thus applied to the ordinary electric circuit.

However, the sheet type thermistor has more advantages such as a low cost, a high reliability, etc. in the process for producing thick film thermistors and the structure than the sandwich type thermistor, because of less processing steps, wide interelectrode distance, etc. That is, the sheet type thermistor is industrially more advantageous than the sandwich type thermistor, if the thermistor film itself can be made to have a low resistance. To this end, two methods can be expected: (i) an electroconductive powder is added to a thick film thermistor composition, and (ii) a material having a low resistance is used as the thermistor powder itself. However, when the electroconductive powder is added to the composition according to said method (i) until the resistance of the sheet type thermistor becomes less than 10 kΩ, the thermistor constant is decreased to less than one-half of the thermistor constant of the thermistor powder itself. Thus, it is very difficult to prepare a sheet type thermistor having such a characteristic that a thermistor constant is more than 2,000 K, while the thermistor has the practical resistance. According to said method (ii), a sheet type thermistor having the desired characteristics can be prepared, using thermistor powders having a specific resistance of less than 100 Ω-cm and containing Cu. However, the thermistor material containing Cu has a problem in stability, and a large change in resistance, and thus cannot be used as a heat-sensitive element of high precision.

Compound metal oxides of pyrochlore (compound oxides of Cd, Bi, Nb, and Ru) are known as a thermistor material containing an oxide of Ru as a noble metal, but require firing at 1,200° C. for 16 hours (Japanese Laid-Open Patent Application Specification No. 118295/75).

SUMMARY OF THE INVENTION

An object of the present invention is to provide a thick film composition being freed from said drawbacks of the prior art, and having such advantages that (i) the firing can be completed within a few hours, and the resulting thick film thermistor has (ii) a high thermistor constant, (iii) a low resistance, (iv) a small change in resistance with time, and (v) no development of cracks when baked onto an alumina substrate.

As a result of various studies to accomplish said object of the present invention, the present inventors have found that a composition obtained by mixing metal oxide powders of at least two of Mn, Co and Ni, and an oxide powder of Ru as a noble metal, firing the resulting mixture, thereby obtaining a compound oxide thermistor of spinel structure, pulverizing the resulting thermistor, and mixing and kneading the resulting thermistor powder with a glass powder and an oxide powder of Ru for adjusting a resistance is effective.

A mixing proportion of the metal oxide powders of at least two of Mn, Co and Ni is preferably within an area surrounded by lines A-B-C-D-E in a triangular diagram shown in FIG. 1 in the accompanying drawings, and points A, B, C, D and E in the triangular diagram have the following compositions:

| | Mn (% by atom) | Ni (% by atom) | Co (% by atom) |
|---|---|---|---|
| A | 80 | 0 | 20 |
| B | 10 | 0 | 90 |
| C | 10 | 50 | 40 |
| D | 50 | 50 | 0 |
| E | 80 | 20 | 0 |

An amount of the oxide of Ru in the powdery mixture of said metal oxide powders and the oxide power of Ru as the noble metal in said composition is preferably 0.5 to 50% by atom on the basis of total of metals in the powdery mixture. When thermistor powders are prepared from powdery mixtures comprising the metal oxide powders and the oxide powder of Ru as the noble metal outside said range, thick film thermistor compositions are prepared from the resulting thermistor powders, and thick film thermistors are prepared therefrom, the resulting thermistors have a coefficient of heat expansion of more than $120\times10^{-7}$ $K^{-1}$, and cracks develop on the thermistor films. Thus, such thermistors cannot be practically used.

An amount of the oxide powder of Ru for adjusting the resistance in the thick film thermistor composition prepared by aiding the oxide powder of Ru for adjusting the resistance and the glass powder to powders of thermistor of composite oxides of spinel structure obtained by firing the powery mixture of said metal oxide powders and the oxide power of Ru is preferably 1–12% by weight on the basis of the total weight of the thick film thermistor composition.

An amount of the glass powder is 20–60% by weight on the basis of the total weight of the thick film thermistor composition. If the amount of the glass powder exceeds 60% by weight, the resistance of the thick film thermistor is so elevated that the thermistor becomes less practical. If the amount of the glass powder is less than 20% by weight, the adhesiveness between the thermistor powders and the oxide powder of Ru baked onto the alumina substrate, or the adhesiveness of these powders to the alumina substrate are so weak that a good film cannot be obtained. When the amount of the oxide powder of Ru for adjusting the resistance is more than 12% by weight, the thermistor constant becomes less than 500K, and the thermistor is less practical. When it is less than 1% by weight on the other hand, the resistance unpreferably becomes dependent upon voltage.

The present invention is valid, even if the thermistor contains oxides of Al and Fe.

DETAILED DESCRIPTION OF THE DRAWINGS

Figure 1:
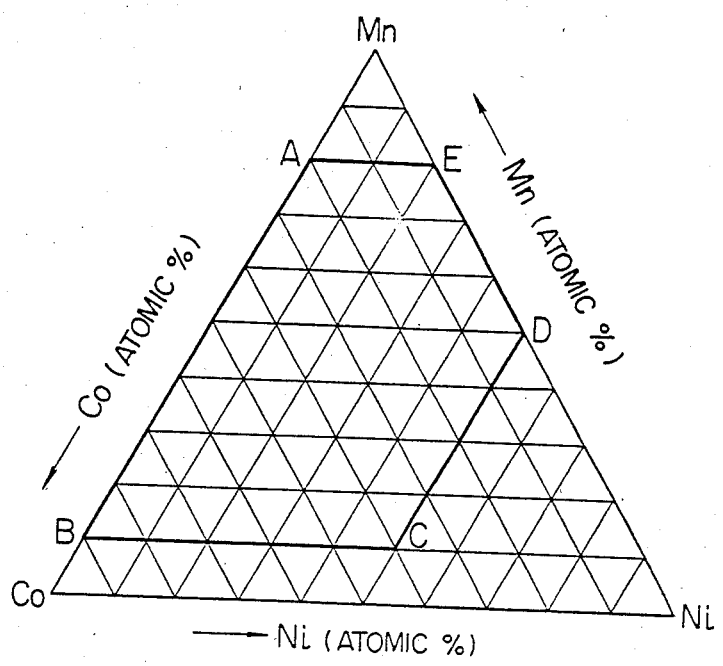
Figure 2:
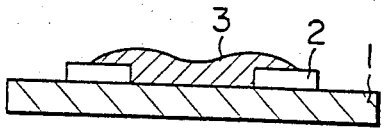

FIG. 1 is a diagram showing a mixing proportion of oxide powders of Mn, Ni and Co in % by atom, and FIG. 2 is a cross-sectional view of a sheet type thermistor.

DETAILED DESCRIPTION OF PREFERRED EMBODIMENTS

The present invention will be described in detail, referring to Examples.

EXAMPLE 1

$MnO_2$ powder, $Co_3O_4$ powder and $RuO_2$ powder were weighed out in a ratio by mole of 1:2:1, and milled and mixed together in an agate mortar for 4 hours. The resulting powdery mixture was placed in an alumina crucible and fired at 900° C. for 2 hours to proceed with solid phase reaction to some extent. Then, the fired mixture was again milled and pulverized in an agate mortar for 4 hours. The resulting powders were fired at 1,250° C. for 2 hours to complete the solid phase reaction, and a thermistor of compound oxides of spinel structure was obtained thereby. The resulting thermistor was pulverized to powders in a ball mill, and the resulting powders were mixed with glass powder having the composition shown in Table 1 and $RuO_2$ powder for adjusting the resistance in proportions shown in Table 2, Nos. 2–9.

10 g each of the resulting powdery mixtures were weighed out, and each powdery mixture was mixed in an agitating grinder for one hour, then admixed with an organic binder (an α-terpineol solution containing ethyl cellulose), and further kneaded for one hour, whereby a thermistor paste was obtained.

A silver-palladium electroconductive paste was screen printed on an alumina substrate 1 shown in FIG. 2, and fired at 850° C. for 10 minutes to form electrodes 2 with an electrode width of 3.5 mm at an electrode distance of 0.5 mm. Then, said thermistor paste was printed thereon, fired at 800° C. to form a thermistor layer 3 with a thermistor width of 3.0 mm and a thermistor thickness of 40 μm, and a sheet type thermistor was obtained thereby.

The thermistor itself had a specific resistance of 5 Ω-cm and a thermistor constant of 2,450K. Resistance, thermistor constant, and change in resistance when left standing at 150° C. for 2,000 hours of the thus formed sheet type thermistors are shown in Table 2, Nos. 2–9.

As is evident from Table 2, all of Nos. 2–8 had lower resistances than No. 1 containing no $RuO_2$, and had thermistor constants substantially equal to that of No. 1 containing no $RuO_2$. That is, sheet type thermistor elements having a low resistance and a high thermistor constant could be obtained. Their stability was also good.

On the other hand, No. 1 containing no $RuO_2$ in Table 2 had a higher resistance than those containing $RuO_2$, and No. 9 containing 14% by weight of $RuO_2$ had a small thermistor constant, and the thick film thermistor No. 1 containing no $RuO_2$ had a dependency of resistance upon voltage, and thus they had a problem in practice.

TABLE 1

| $SiO_2$ | PbO | $B_2O_3$ | $Al_2O_3$ | $Bi_2O_3$ | CaO | BaO |
|---|---|---|---|---|---|---|
| 24 | 25 | 20 | 4 | 6 | 6 | 15 |

TABLE 2

| | Mixing proportion of powders (wt %) | | | Sheet type thermistor characteristics | | | |
|---|---|---|---|---|---|---|---|
| No. | Thermistor powder | Glass powder | $RuO_2$ powder | Resistance (Ω, 25° C.) | Thermistor constant B(K) | Stability, change in resistance (%) | Voltage dependency |
| 1 | 60 | 40 | 0 | $1.6 \times 10^4$ | 2320 | +1.6 | poor |
| 2 | 59 | 40 | 1 | $1.3 \times 10^4$ | 2320 | +1.6 | good |
| 3 | 58 | 40 | 2 | $7.3 \times 10^3$ | 2330 | +1.6 | good |
| 4 | 56 | 40 | 4 | $5.2 \times 10^3$ | 2320 | +1.4 | good |
| 5 | 54 | 40 | 6 | $3.4 \times 10^3$ | 2310 | +1.5 | good |
| 6 | 52 | 40 | 8 | $1.3 \times 10^3$ | 2300 | +1.3 | good |
| 7 | 50 | 40 | 10 | $9.8 \times 10^2$ | 2300 | +1.2 | good |
| 8 | 48 | 40 | 12 | $2.3 \times 10^2$ | 2000 | +1.3 | good |
| 9 | 46 | 40 | 14 | $1.4 \times 10^{-1}$ | 340 | +1.0 | good |

EXAMPLE 2

$MnO_2$ powder, NiO powder, $Fe_2O_3$ powder and $RuO_2$ powder were weighed out in a ratio by mole of 3:2:0.5:0.5, and subjected to solid phase reaction in the same manner as in Example 1 to obtain a thermistor of compound metal oxide of spinel structure. The resulting thermistor was pulverized to powders in the same manner as in Example 1. The resulting powders were mixed with the glass powder having the composition given in Table 1 and $RuO_2$ powder for adjusting the resistance in proportions given in Table 3, Nos. 2–9 and 11–18. 10 g each of the resulting mixtures was prepared into a thermistor paste in the same manner as in Example 1, and a sheet type thermistor was prepared therefrom. Resistance, thermistor constant and change in resistance when left standing at a high temperature of the sheet type thermistors are given in Table 3, Nos. 2–9 and 11–18. The thermistor material itself had a specific resistance of 42 Ω-cm and a thermistor constant of 3,000K.

As is evident from Table 3, Nos. 2–9, and 11–18 had a lower resistance than No. 1 and No. 10 containing no $RuO_2$ in Table 3, when the content of glass powder was constant and had a thermistor constant substantially equal to that of No. 1 containing no $RuO_2$. That is, sheet type thermistor elements having a low resistance and a high thermistor constant could be obtained. Their stability was also good.

On the other hand, No. 1 and No. 10 containing no $RuO_2$ in Table 3 had a higher resistance than those containing $RuO_2$, and No. 9 and No. 18 containing 14% by weight of $RuO_2$ in Table 3 had a small thermistor constant, the thick film thermistors No. 1 and No. 10 containing no $RuO_2$ had a dependency of resistance upon voltage, and thus they had a problem in practice.

TABLE 3

| No. | Mixing proportion of powders (wt %) Thermistor powder | Glass powder | $RuO_2$ powder | Sheet type thermistor characteristics Resistance (Ω, 25° C.) | Thermistor constant B(K) | Stability, change in resistance (%) | Voltage dependency |
|---|---|---|---|---|---|---|---|
| 1 | 65 | 35 | 0 | $1.3 \times 10^5$ | 2850 | +1.2 | poor |
| 2 | 64 | 35 | 1 | $9.7 \times 10^4$ | 2850 | +1.1 | good |
| 3 | 63 | 35 | 2 | $9.3 \times 10^4$ | 2840 | +1.0 | good |
| 4 | 61 | 35 | 4 | $6.6 \times 10^4$ | 2830 | +1.3 | good |
| 5 | 59 | 35 | 6 | $4.3 \times 10^4$ | 2840 | +1.2 | good |
| 6 | 57 | 35 | 8 | $9.7 \times 10^3$ | 2830 | +1.0 | good |
| 7 | 55 | 35 | 10 | $7.8 \times 10^3$ | 2820 | +0.9 | good |
| 8 | 53 | 35 | 12 | $1.8 \times 10^3$ | 2060 | +1.3 | good |
| 9 | 51 | 35 | 14 | $2.3 \times 10^{-1}$ | 440 | +1.1 | good |
| 10 | 80 | 20 | 0 | $6.5 \times 10^4$ | 2850 | +1.2 | poor |
| 11 | 79 | 20 | 1 | $9.3 \times 10^3$ | 2850 | +1.1 | good |
| 12 | 78 | 20 | 2 | $4.7 \times 10^3$ | 2840 | +1.0 | good |
| 13 | 76 | 20 | 4 | $3.3 \times 10^3$ | 2830 | +1.3 | good |
| 14 | 74 | 20 | 6 | $2.6 \times 10^3$ | 2840 | +1.2 | good |
| 15 | 72 | 20 | 8 | $4.5 \times 10^2$ | 2830 | +1.0 | good |
| 16 | 70 | 20 | 10 | $3.7 \times 10^2$ | 2820 | +0.9 | good |
| 17 | 68 | 20 | 12 | $1.1 \times 10^2$ | 2060 | +1.3 | good |
| 18 | 66 | 20 | 14 | $1.4 \times 10^{-1}$ | 440 | +1.1 | good |

EXAMPLE 3

$MnO_2$ powder, NiO powder, $Fe_2O_3$ powder, $Al_2O_3$ powder and $RuO_2$ powder were weighed out in a ratio by mole of 3:3:0.3:0.4:1 and subjected to solid phase reaction in the same manner as in Example 1 to obtain a thermistor of compound oxides of spinel structure. The thermistor was pulverized to powders in the same manner as in Example 1. The resulting powders were mixed with glass powder having the composition given in Table 1 and $RuO_2$ powder for adjusting the resistance in proportions given in Table 4, Nos. 2–9 and 11–18. 10 g each of the resulting mixtures was weighed out and formed into a sheet type thermistor in the same manner as in Example 1. The thermistor material itself had a specific resistance of 10 Ω-cm and a thermistor constant of 2,640K. Resistance, thermistor constant, and change in resistance when left standing at a high temperature of the sheet type thermistors are given in Table 4, Nos. 2–9 and 11–18.

As is evident from Table 4, Nos. 2–9 and Nos. 11–18 had a lower resistance than No. 1 and No. 10 containing no $RuO_2$, when the content of glass powder was constant and had a thermistor constant substantially equal to that of No. 1 and No. 10 containing no $RuO_2$. That is, sheet type thermistor elements having a low resistance and a high thermistor constant could be obtained. Their stability was also good.

On the other hand, No. 1 and No. 10 containing no $RuO_2$ in Table 4 had a higher resistance than those containing $RuO_2$, and No. 9 and No. 18 containing 14% by weight of $RuO_2$ in Table 4 had a small thermistor constant, and the thick film thermistors No. 1 and No. 10 containing no $RuO_2$ had a dependency of resistance upon voltage, and thus they had a problem in practice.

TABLE 4

| No. | Mixing proportion of powders (wt %) Thermistor powder | Glass powder | $RuO_2$ powder | Sheet type thermistor characteristics Resistance (Ω, 25° C.) | Thermistor constant B(K) | Stability, change in resistance (%) | Voltage dependency |
|---|---|---|---|---|---|---|---|
| 1 | 65 | 35 | 0 | $3.4 \times 10^4$ | 2530 | +2.0 | poor |
| 2 | 64 | 35 | 1 | $2.7 \times 10^4$ | 2530 | +2.0 | good |
| 3 | 63 | 35 | 2 | $1.5 \times 10^4$ | 2520 | +2.0 | good |
| 4 | 61 | 35 | 4 | $1.1 \times 10^4$ | 2530 | +1.5 | good |
| 5 | 59 | 35 | 6 | $7.1 \times 10^3$ | 2520 | +1.6 | good |
| 6 | 57 | 35 | 8 | $2.7 \times 10^3$ | 2510 | +1.5 | good |
| 7 | 55 | 35 | 10 | $2.1 \times 10^3$ | 2320 | +1.7 | good |
| 8 | 53 | 35 | 12 | $4.8 \times 10^2$ | 2010 | +1.8 | good |
| 9 | 51 | 35 | 14 | $1.4 \times 10^{-1}$ | 380 | +1.5 | good |
| 10 | 40 | 60 | 0 | $9.8 \times 10^4$ | 2530 | +2.0 | poor |
| 11 | 39 | 60 | 1 | $6.4 \times 10^4$ | 2530 | +2.0 | good |
| 12 | 38 | 60 | 2 | $4.3 \times 10^4$ | 2520 | +2.0 | good |
| 13 | 36 | 60 | 4 | $2.7 \times 10^4$ | 2530 | +1.5 | good |
| 14 | 34 | 60 | 6 | $1.6 \times 10^4$ | 2520 | +1.6 | good |
| 15 | 32 | 60 | 8 | $6.8 \times 10^3$ | 2510 | +1.5 | good |
| 16 | 30 | 60 | 10 | $6.0 \times 10^3$ | 2320 | +1.7 | good |
| 17 | 28 | 60 | 12 | $2.3 \times 10^3$ | 2010 | +1.8 | good |
| 18 | 26 | 60 | 14 | $1.4 \times 10$ | 380 | +1.5 | good |

EXAMPLE 4

$Mn_3O_4$ powder, $Co_3O_4$ powder, NiO powder, and $RuO_2$ powder were weighed out in a ratio by mole of 2:1:1.5:1, and subjected to a solid phase reaction in the same manner as in Example 1 to obtain a thermistor of compound oxide of spinel structure. The resulting thermistor was pulverized to powders in the same manner as in Example 1. The resulting powders were mixed with glass powder having the composition given in Table 1 and $RuO_2$ powder for adjusting the resistance in proportions given in Table 5, Nos. 2–9.

10 g each of the resulting mixtures was weighed out, and prepared into a sheet type thermistor in the same manner as in Example 1. The thermistor material itself had a specific resistance of 10 Ω-cm and a thermistor constant of 2,640K. Resistance, thermistor constant and change in resistance when left standing at a high temperature of the sheet type thermistors are shown in Table 5, Nos. 2–9.

As is evident from Table 5, Nos. 2–9 have a lower resistance than No. 1 containing no $RuO_2$, and had a thermistor constant substantially equal to that of No. 1 containing no $RuO_2$. That is, sheet type thermistor elements having a low resistance and a high thermistor constant can be obtained. Their stability was also good.

On the other hand, No. 1 containing no $RuO_2$ in Table 5 had a higher resistance than those containing $RuO_2$, and No. 9 containing 14% by weight of $RuO_2$ in Table 5 had a small thermistor constant, and No. 1 containing no $RuO_2$ had a dependency of resistance upon voltage and thus they had a problem in practice.

TABLE 5

| No. | Mixing proportion of powders (wt %) | | | Sheet type thermistor characteristics | | | |
|---|---|---|---|---|---|---|---|
| | Thermistor powder | Glass powder | $RuO_2$ powder | Resistance (Ω, 25° C.) | Thermistor constant B(K) | Stability, change in resistance (%) | Voltage dependency |
| 1 | 60 | 40 | 0 | $6.3 \times 10^4$ | 2860 | +0.7 | poor |
| 2 | 59 | 40 | 1 | $5.1 \times 10^4$ | 2850 | +0.6 | good |
| 3 | 58 | 40 | 2 | $2.8 \times 10^4$ | 2840 | +0.7 | good |
| 4 | 56 | 40 | 4 | $2.0 \times 10^4$ | 2830 | +0.4 | good |
| 5 | 54 | 40 | 6 | $1.3 \times 10^4$ | 2830 | +0.5 | good |
| 6 | 52 | 40 | 8 | $4.1 \times 10^3$ | 2800 | +0.4 | good |
| 7 | 50 | 40 | 10 | $3.6 \times 10^3$ | 2800 | +0.6 | good |
| 8 | 48 | 40 | 12 | $9.6 \times 10^2$ | 2790 | +0.5 | good |
| 9 | 46 | 40 | 14 | $2.6 \times 10$ | 480 | +0.5 | good |

What is claimed is:

1. A thick film thermistor composition, which comprises (a) a powdery thermistor of compound oxides of spinel structure consisting essentially of a fired powdery mixture of metal oxide powders of at least two of Mn, Co and Ni, and an oxide powder of Ru as a noble metal, (b) an oxide powder of Ru for adjusting a resistance, and (c) a glass powder, wherein (i) a mixing proportion of the metal oxide powders of at least two of Mn, Co and Ni is in an area surrounded by lines A-B-C-D-E in a triangular diagram of FIG. 1, and an amount of the oxide powder of Ru as the noble metal is 0.5 to 50% by atom on the basis of total of metal components in the metal oxide powders of at least two of Mn, Co and Ni, and the oxide powder of Ru, and (ii) amounts of the oxide powder of Ru for adjusting a resistance and an amount of the glass powder are 1 to 12% by weight and 20 to 60% by weight, respectively, on the basis of total of the powdery thermistor of the compound oxides of spinel structure comprising the fired powdery mixture of the metal oxides of at least two of Mn, Co and Ni, and the oxide powder of Ru as the noble metal, the glass powder and the oxide powder of Ru for adjusting a resistance, the balance being the powdery thermistor, and points A, B, C, D, and E of FIG. 1 have the following compositions:

| | Mn (% by atom) | Ni (% by atom) | Co (% by atom) |
|---|---|---|---|
| A | 80 | 0 | 20 |
| B | 10 | 0 | 90 |
| C | 10 | 50 | 40 |
| D | 50 | 50 | 0 |
| E | 80 | 20 | 0 |

2. A thick film thermistor composition according to claim 1, wherein the oxide powders of at least two of Mn, Co and Ni is a mixture of $MnO_2$ powder and $Co_3O_4$ powder, a mixture of $MnO_2$ powder and a NiO powder, or a mixture of $Mn_3O_4$ powder, $Co_3O_4$ powder and NiO powder.

3. A thick film thermistor composition according to claim 1, consisting essentially of said powdery thermistor of compound oxides of spinel structure, said oxide powder of Ru for adjusting a resistance and said glass powder.

4. A thick film thermistor composition according to claim 3, wherein the oxide powder of Ru as the noble metal and the oxide powder of Ru for adjusting a resistance are $RuO_2$ powder.

5. A thick film thermistor composition according to claim 4, wherein the glass powder is a mixture of $SiO_2$, PbO, $B_2O_3$, $Al_2O_3$, $Bi_2O_3$, CaO and BaO.

6. A thick film thermistor composition according to claim 1, wherein the oxide powder of Ru as the noble metal and the oxide powder of Ru for adjusting a resistance are $RuO_2$ powder.

7. A thick film thermistor composition according to claim 1, wherein the glass powder is a mixture of $SiO_2$, PbO, $B_2O_3$, $Al_2O_3$, $Bi_2O_3$, CaO and BaO.

* * * * *